US005478980A

United States Patent [19]

Freeman et al.

[11] Patent Number: 5,478,980

[45] Date of Patent: Dec. 26, 1995

[54] COMPACT LOW FORCE DEAD TANK CIRCUIT BREAKER INTERRUPTER

[75] Inventors: Willie B. Freeman, Irwin, Pa.; Joachim Stechbarth, Siglistorf, Switzerland; Anthony S. Masarik, Jeannette, Pa.

[73] Assignee: ABB Power T&D Company, Inc., Blue Bell, Pa.

[21] Appl. No.: 222,831

[22] Filed: Apr. 5, 1994

[51] Int. Cl.[6] ..... H01H 33/88; H01H 33/91

[52] U.S. Cl. ..... 218/59; 218/62; 218/63; 218/84

[58] Field of Search ..... 200/148 R, 148 A, 200/148 B, 148 F, 148 BV; 218/57–67, 84, 88

[56] References Cited

U.S. PATENT DOCUMENTS

| | | | |
|---|---|---|---|
| 3,694,592 | 9/1972 | Kuhn | 200/48 R |
| 3,700,840 | 10/1972 | Wilson et al. | 200/48 R |
| 4,132,876 | 1/1979 | Sato et al. | 218/62 |
| 4,211,902 | 7/1980 | Tsuchidu | 218/43 |
| 4,442,330 | 4/1984 | Oshita et al. | 218/65 |
| 4,460,937 | 7/1984 | Kumata et al. | 361/604 |
| 4,973,806 | 11/1990 | Kirchesch et al. | 218/84 |
| 5,025,118 | 6/1991 | Meinherz et al. | 218/51 |

*Primary Examiner*—J. R. Scott

*Attorney, Agent, or Firm*—Woodcock Washburn Kurtz Mackiewicz & Norris

[57] ABSTRACT

A dead tank high voltage $SF_6$ circuit breaker has a stationary cylinder $SF_6$ puffer section, an arc generated $SF_6$ pressure blast section, a moving arcing contact plug, and a moving open position shield. The contacts are operated by a reduced size operating mechanism which can be used for both 145 kV and 242 kV circuit breakers.

4 Claims, 3 Drawing Sheets

COMPACT LOW FORCE DEAD TANK CIRCUIT BREAKER INTERRUPTER

BACKGROUND OF THE INVENTION

This invention relates to circuit interrupters, and more specifically relates to a novel circuit interrupter which has a compact size and can be operated by a low drive force.

High voltage circuit interrupters are well known. The circuit breaker operating mechanism must provide the necessary drive force to move the contacts between their engaged and disengaged positions, and cause $SF_6$ gas to flow at high mass flow through the arc drawn between the separating contacts. Different drive mechanisms and breaker sizes are used for circuit breakers of different ratings since different operating forces are needed. For example, the operating mechanism and drive system for a 242 kV breaker is larger than that for a 145 kV breaker.

SUMMARY OF THE INVENTION

In accordance with the present invention, the features of a stationary cylinder $SF_6$ puffer interrupter, an arc-generated $SF_6$ pressure blast interrupter, a moving (nozzle driven) arcing contact plug, and a moving (nozzle driven) opened position contact shield are combined into a single interrupter.

The combination results in a reduced size and drive force for the operating mechanism. Thus, the operating mechanism designed for a 145 kV breaker may be used for a 242 kV breaker. Furthermore, when using the novel interrupter of the invention, the breaker size for a 242 kV breaker is increased only by the higher dielectric requirements, allowing its configuration to be the same as the 145 kV rated breaker. Therefore, the common configuration for the operating mechanism and linkage system simplifies the production of both 145 kV and 242 kV dead tank breakers.

Other features and advantages of the present invention will become apparent from the following description of the invention which refers to the accompanying drawings.

DETAILED DESCRIPTION OF THE DRAWINGS

Figure 1:
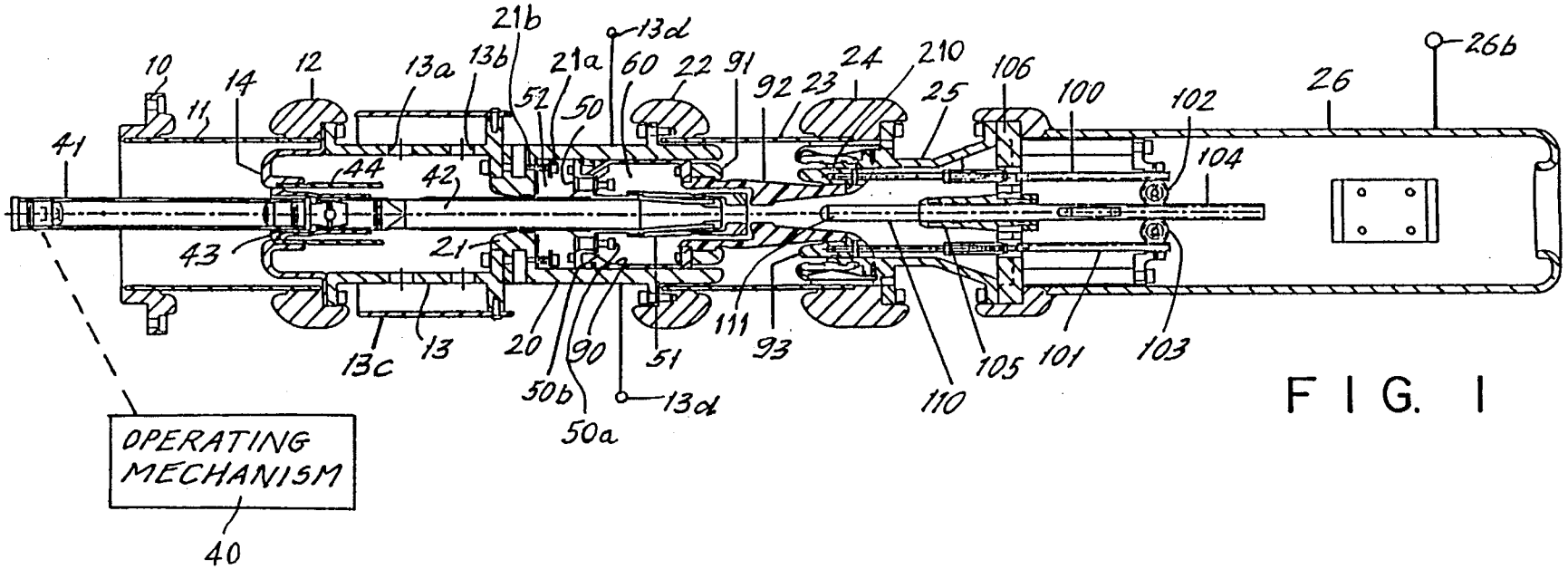
FIG. 1 is a schematic cross-sectional view of the interrupter of the present invention, taken through its axis, showing the contacts in their open position.
Figure 2:
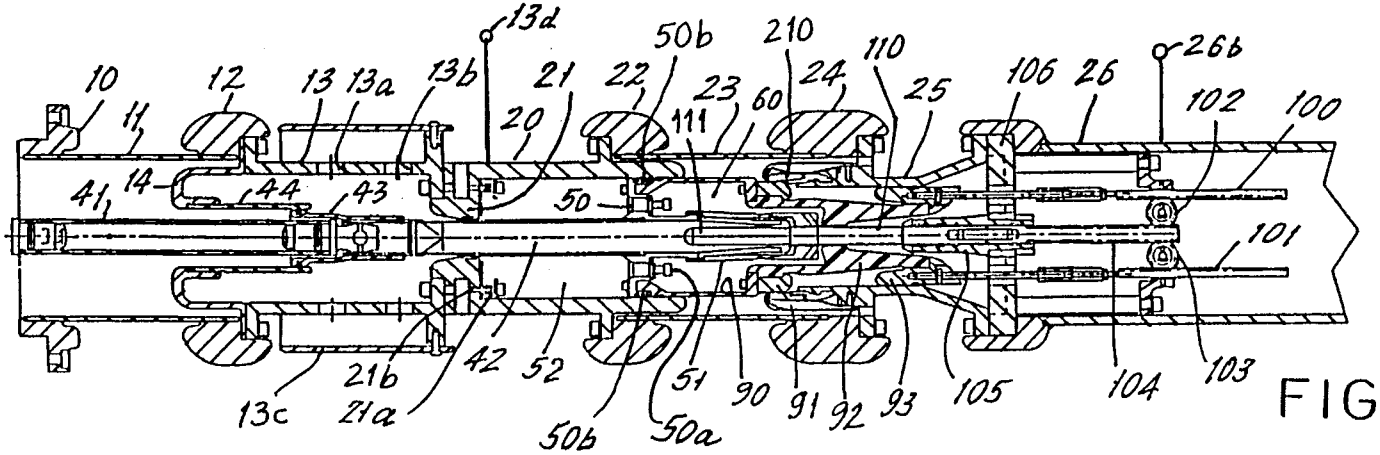
FIG. 2 is a schematic cross-section like that of FIG. 1, with the contacts closed.
Figure 4:
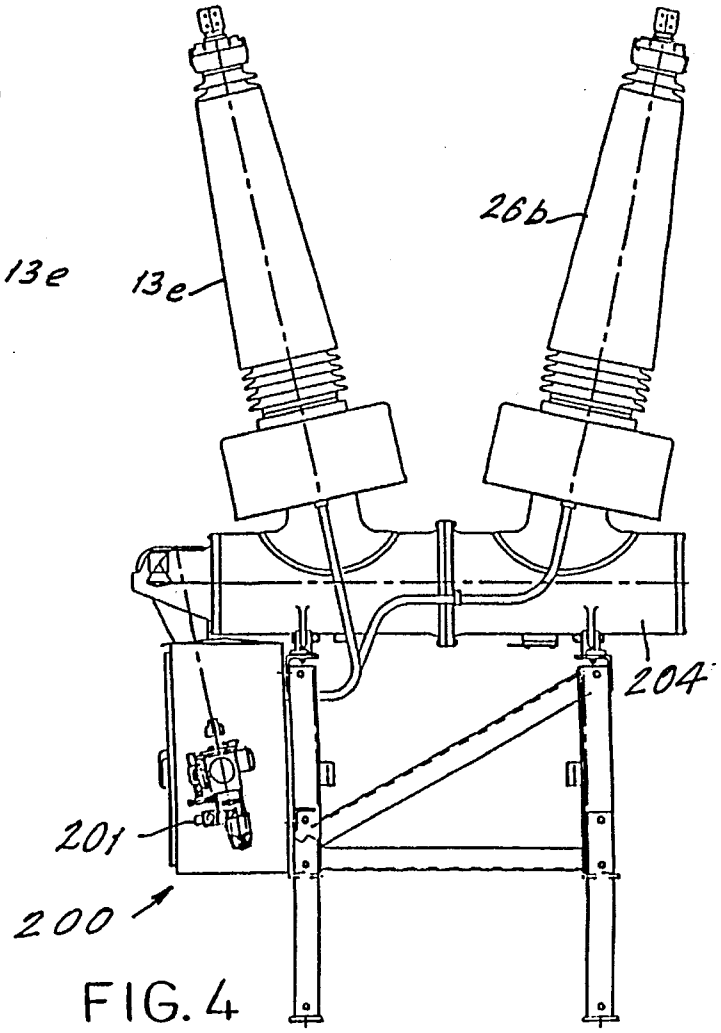
FIG. 4 is a side view of the circuit breaker of FIG. 3.
Figure 3:
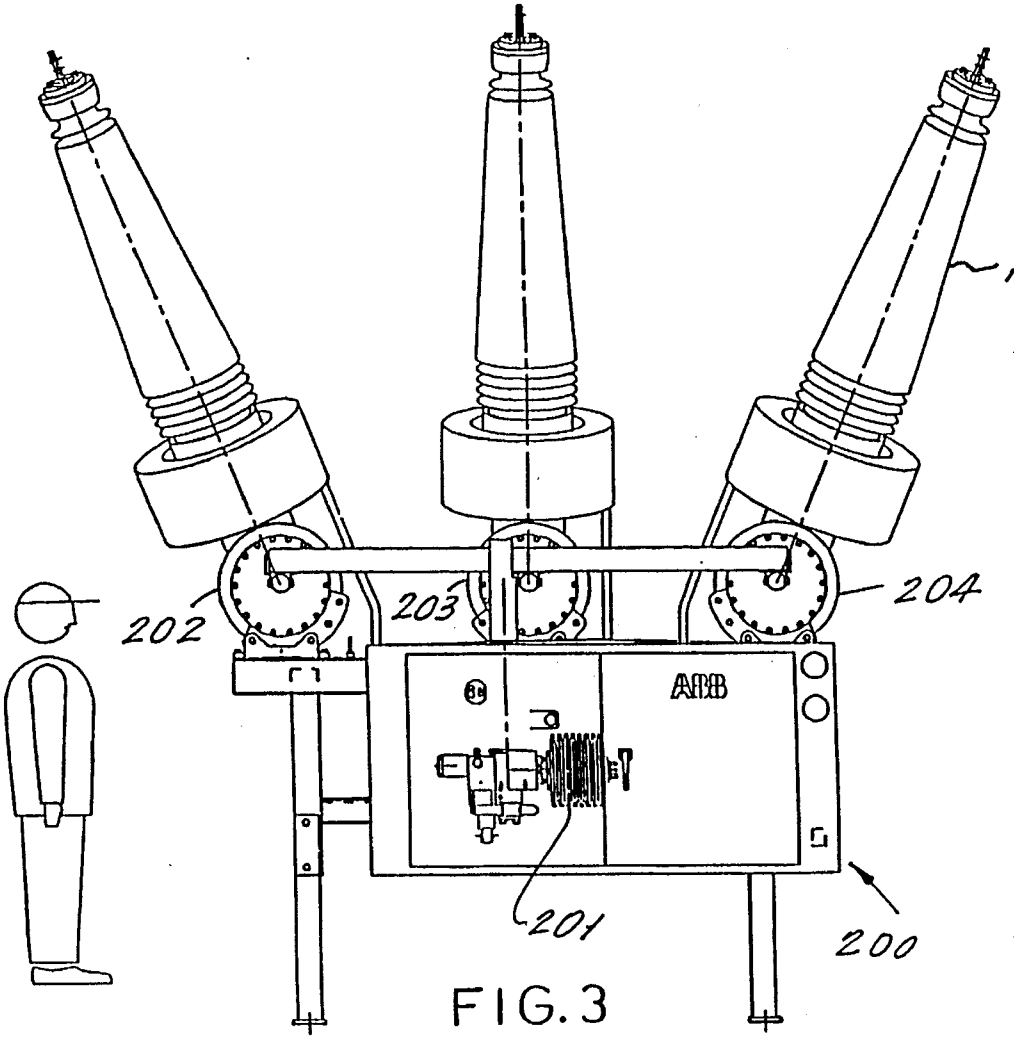
FIG. 3 is an elevational view of a circuit breaker which uses the interrupters of the present invention.

Referring first to FIGS. 1 and 2, the novel interrupter structure is contained within a dead tank housing, as shown in FIGS. 3 and 4, which is filled with $SF_6$ and has suitable bushing conductors entering the tank and connected to the terminals of the interrupter.

Figure 5:
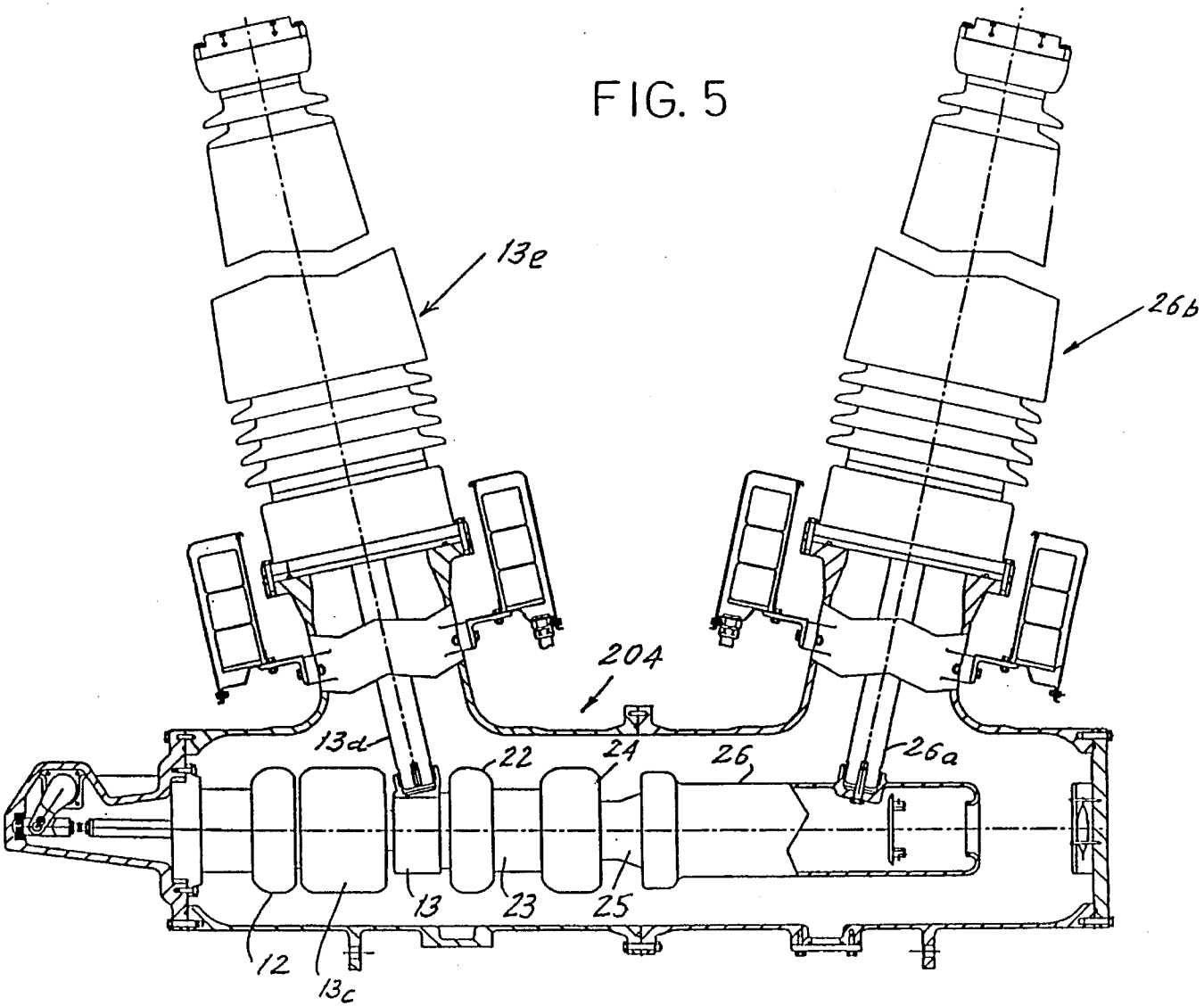
FIG. 5 is a partial cross-sectional view of a single pole of FIGS. 3 and 4, and shows the interrupter structure of FIGS. 1 and 2 contained therein.

The outer housing of the interrupter has a mounting flange 10 which is connected by tube 11 to cylindrical conductive shield 12. Shield 12 is bolted to casting tube 13 which has a series of gas openings 13*a* and 13*b* extending around its periphery. A grading shield 14 is fixed between members 12 and 13. The right-hand end of tube 13 has a cylindrical baffle 13*c* extending therefrom, over the length of tube 13. Tube 13 is a part of one terminal of the interrupter and, as shown in FIG. 5, is connected to bushing conductor 13*d* of bushing 13*e*.

A stationary puffer cylinder 20 is fixed to the right-hand end of tube 13, and a piston ring 21 is captured between tubes 13 and 20. Check valves 21*a* are formed in ring 21 which permit gas flow into the volume to the right of ring 21 through inlet openings 21*b* in cylinder 20. A shield 22 is fixed to puffer cylinder 20 and an insulation tube 23 extends from stationary shield 22 to a stationary shield 24, which is fixed to the left-hand end of conductive member 25. Member 25 is then bolted to the end cylinder 26, thus completing the outer housing of the interrupter. End cylinder 26 also acts as the other terminal of the interrupter as best shown in FIG. 5, and is connected to conductor 26*a* of bushing 26*b*.

An operating mechanism 40 is connected to the pull rod 41 which is, in turn, connected to conductive rod 42. Rod 42 carries a pressure seal 43 which slides along and seals between rod 42 and cylinder 44.

Rod 42 is also slidably supported within member or piston ring 21 and is fixed to puffer piston 50 which rides within puffer cylinder 20 and is fixed to the arcing finger or first interrupter contact 51. Piston 50 also carries check valves 50*a*, and carries a sliding contact 50*b* which makes sliding contact with the interior diameter of cylinder 20. Thus, an a puffer compression volume 52 is defined within member 20, which generates a high pressure for $SF_6$ within volume 52 when the breaker contacts open and close between the positions of FIGS. 1 and 2. Note that suitable gas flow channels through piston 50 are formed in the known manner to lift check valve 50*a* to allow the puffer operation to proceed.

A second chamber 60 is formed to the right of piston 50. Chamber 60 is an arc-generated pressure volume which produces a high pressure for the $SF_6$ in the chamber during arcing to the arcing contact 51.

Piston 50 is also connected to sliding tube 90 within chamber 60. Conductive tube 90 is connected at its right-hand end to main contact ring 91 which is connected, in turn, to the main insulation interrupter nozzle 92 which controls $SF_6$ gas flow. The opposite end of nozzle 92 is connected to movable shield 93. Shield 93 moves with nozzle 92 when the nozzle moves to its open position (shown in FIG. 1) and it is in this position that it is aligned with stationary shield 24 and augments the action of shield 24. From the foregoing, it will be understood that nozzle is operatively connected to piston 50 and moves therewith. The nozzle 92 surrounds the second interrupter contact or front portion 111 of rod 110 for guiding the flow of interrupting gas through the gap between the first and second interrupter contacts (51 and 111, respectively) when they move out of engagement with one another as shown in FIG. 1. The movable shield 93, as indicated above, is fixed to the movable nozzle 92 and therefore moves with it. The shield 93 is disposed in a remote and non-shielding position when the first and second interrupter contacts (51,111) are in engagement with one another, as shown in FIG. 2. From this remote position and non-shielding position, shield 93 moves with nozzle 92 and moves to the position shown in FIG. 1 in surrounding relationship with respect to the second interrupter contact 111 when the first and second interrupter contacts (51,111) are moved out of engagement with one another.

Shield 93 is then connected to racks 100 and 101 which drive stationary gears 102 and 103. Gears 102 and 103 then, in turn, drive the moving central rack 104 which is connected to the arcing contact rod or plug 110. The front portion 111 of rod 110 comprises the second interrupter contact. Contact rod 110 is guided in its motion by transfer contact sleeve 105 supported in conductive plate 106 which is captured between members 25 and 26. Thus, electrical contact is made between cylinder 26 and the arcing contact rod 110. The arcing plug or contact rod 110 is then driven as shown in the figures in response to the movement of rod 41 by operating mechanism 40.

The current path through the interrupter, when the interrupter is closed, is shown in FIG. 2, and extends from bushing conductor 13*d*, cylinder 20, transfer contact 50*b*, conductive tube 90, main contact 91, movable main contact 210, member 25, and member 26 to bushing conductor 26*b*.

To open the interrupter, rod 41–42 moves to the left as shown in FIG. 1. This moves contact 91 away from movable main contact 210 to open the main gap. At the same time, arcing contact 51 moves to the left and rod or plug 110 moves to the right due to the movement of rack 104. Arcing contacts 51 and the forward end of rod 110 i.e., the plug portion 111, subsequently disengage, drawing an arc which is extinguished by both the flow of puffer-generated gas forced to flow by the movement of piston 50 compressing the interruption gas, and by the pressure generated by the arc within chamber 60.

The novel interrupter of FIGS. 1 and 2 can be assembled into the circuit breaker shown in FIGS. 3 and 4 for a rating, for example, of either 145 kV or 242 kV without charging the operating mechanism. FIGS. 3 and 4 show a three-phase dead tank circuit breaker containing a stand 200 which contains an operating mechanism 201 (which is the mechanism 40 of FIGS. 1 and 2) and supports three interrupter tanks 202, 203 and 204 which each contain an interrupter assembly and are filled with $SF_6$ gas. The assembly of one pole of the circuit breaker is shown in FIG. 5.

Each of the interrupter tanks has a conventional pair of bushings, shown as bushings 13*e* and 26*b* for tank 204 of FIG. 5, which have central conductors 13*d* and 26*a*, respectively, which enter the grounded tanks 202, 203 and 204 and make contact with the interrupter terminals within the tanks.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An interrupter structure comprising, in combination:

first and second interrupter contacts movable along a common axis relative to one another and into and out of engagement with respect to one another;

first and second linearly movable operating rods operatively connected to said first and second interrupter contacts respectively;

a stationary cylinder surrounding said common axis and having a piston movable therein and fixed thereto; said piston being fixed to and movable with said first movable operating rod; said piston dividing said stationary cylinder into a gas puffer chamber and an arc blast chamber;

an interruption gas filling said interrupter structure and said stationary cylinder;

said first and second interrupter contacts being disposed within said arc blast chamber when they are moved out of engagement with one another to produce an arc generated blast of interruption gas through the gap between said first and second interrupter contacts when they are moved out of engagement with one another;

said piston compressing the interruption gas in said gas puffer chamber to produce a further gas blast through the gap between said first and second interrupter contacts when they are moved out of engagement with one another;

a movable nozzle operatively connected to said piston and movable therewith, said movable nozzle surrounding said second interrupter contact for guiding the flow of interrupting gas through the gap between said first and second interrupter contacts when said first and second interrupter contacts move out of engagement with one another;

movable shield means fixed to said movable nozzle and movable therewith, said shield means being disposed in a remote and non-shielding position when said first and second interrupter contacts are in engagement with one another and being disposed in a shielding position and in surrounding relationship with respect to said second interrupter contact when said first and second interrupter contacts are moved out of engagement with one another; and means coupling said first and second operating rods to mechanically move said second interrupter contact in a direction away from said first interrupter contact when said first operating rod is operated to move said first and second interrupter contacts away from one another.

2. The device of claim 1 wherein said interruption gas is $SF_6$.

3. The device of claim 2 wherein said means coupling said first and second operating rods includes a first rack means connected to said first operating rod, a stationary pinion means coupled to and rotated by said first rack means, and a second rack means coupled to said second interrupter contact and to said pinion means, whereby linear movement of said first rack means in one direction causes linear movement of said second rack means in an opposite direction.

4. The interrupter structure of claim 1 which further includes a stationary shield disposed in surrounding relationship with respect to said movable shield when said movable shield is in said shielding position.

* * * * *

UNITED STATES PATENT AND TRADEMARK OFFICE

CERTIFICATE OF CORRECTION

PATENT NO. : 5,478,980

DATED : December 26, 1995

INVENTOR(S) : Willie B. Freeman; Joachim Stechbarth; Anthony S. Masarik

It is certified that error appears in the above-indentified patent and that said Letters Patent is hereby corrected as shown below:

At column 2, line 54, after "nozzle" insert --92--.

Signed and Sealed this

Sixteenth Day of April, 1996

Bruce Lehman

*Attest:*

BRUCE LEHMAN

*Attesting Officer*

*Commissioner of Patents and Trademarks*